US006955565B2

(12) United States Patent
Lloyd et al.

(10) Patent No.: US 6,955,565 B2
(45) Date of Patent: Oct. 18, 2005

(54) CABLE CONNECTOR WITH SHIELDED TERMINATION AREA

(75) Inventors: Brian Keith Lloyd, Maumelle, AR (US); Richard A. Hays, Conway, AR (US); Edward Seamands, Little Rock, AR (US); Kenneth F. Janota, Little Rock, AR (US); Munewar Ahmad, Conway, AR (US); Michael Magajne, Cicero, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/745,046

(22) Filed: Dec. 23, 2003

(65) Prior Publication Data

US 2004/0229510 A1 Nov. 18, 2004

Related U.S. Application Data

(60) Provisional application No. 60/437,044, filed on Dec. 30, 2002.

(51) Int. Cl.[7] ..... H01R 13/58
(52) U.S. Cl. ..... 439/607; 439/610
(58) Field of Search ..... 439/607, 610, 439/497, 579, 609, 493–496; 29/858

(56) References Cited

U.S. PATENT DOCUMENTS

| | | | | |
|---|---|---|---|---|
| 4,826,443 | A * | 5/1989 | Lockard | 439/101 |
| 5,032,089 | A * | 7/1991 | Hansell, III | 439/609 |
| 5,176,538 | A * | 1/1993 | Hansell et al. | 439/607 |
| 6,017,245 | A * | 1/2000 | Karir | 439/610 |
| 6,203,376 | B1 * | 3/2001 | Magajne et al. | 439/610 |
| 6,217,372 | B1 * | 4/2001 | Reed | 439/497 |
| 6,273,758 | B1 * | 8/2001 | Lloyd et al. | 439/607 |
| 6,394,839 | B2 * | 5/2002 | Reed | 439/497 |
| 6,428,344 | B1 * | 8/2002 | Reed | 439/455 |
| 6,524,135 | B1 * | 2/2003 | Feldman et al. | 439/610 |
| 6,652,296 | B2 * | 11/2003 | Kuroda et al. | 439/95 |
| 6,655,992 | B1 * | 12/2003 | Ko | 439/579 |
| 6,663,415 | B1 * | 12/2003 | Wu | 439/460 |
| 6,705,893 | B1 * | 3/2004 | Ko | 439/607 |
| 6,755,687 | B1 * | 6/2004 | Ko | 439/579 |
| 6,823,587 | B2 * | 11/2004 | Reed | 29/858 |

FOREIGN PATENT DOCUMENTS

EP 1 263 087 12/2002

OTHER PUBLICATIONS

International Search Report in PCT Application No. PCT/US2003/41333, the PCT counterpart of the present application, mailed Apr. 26, 2004.

* cited by examiner

*Primary Examiner*—Alexander Gilman
(74) *Attorney, Agent, or Firm*—Thomas D. Paulius

(57) ABSTRACT

A cable connector is provided that has a connector housing that is thin and takes the form of a wafer. Terminals are held within the housing and termination portions extend lengthwise from the terminals. The termination portions extend out from the housing for terminating bare conductors of signal wires to them. A grounding shield is provided that extends over the signal terminals from their contact portions at the front end of the connector to their rear termination portions. The grounding shield thereby provided a ground extent over the termination area that increases the electrical affinity of the signal wires to the grounding shield so as to reduce crosstalk and noise during operation at high frequencies. In one embodiment, the grounding shield includes a separate extension that is connected to the base grounding shield. In another embodiment, the grounding shield has a length sufficient to extend over the termination area.

16 Claims, 7 Drawing Sheets

CABLE CONNECTOR WITH SHIELDED TERMINATION AREA

REFERENCE TO RELATED APPLICATIONS

This application claims priority of U.S. Provisional Patent Application No. 60/437,044, filed Dec. 30, 2002.

BACKGROUND OF THE INVENTION

The present invention relates generally to connectors used in high-speed and high-density cable connector assemblies, and more particularly to a cable connector that has an improved grounding shield.

In the field of telecommunications and in other electronic fields, cable assemblies are used to connect one electronic device to another. In many instances, the cable assemblies have at one or more of their ends, a plurality of connector modules, each of which serves to connect a plurality of individual wires to an opposing connector, such as a pin connector. It is desirable to provide very high density pin counts while maintaining superior cross-talk performance. Proper selective grounding of certain terminals is required to provide increased data transfer.

Structures for attaining these aims are known in the art, but tend to be bulky and require additional, valuable, empty unused area. Such a structure is shown in U.S. Pat. No. 5,176,538, issued Jan. 5, 1993, and is shown to include a connector having a plurality of slots and cavities with signal contacts being received within the cavities of the connector. A grounding shield is provided having a plurality of contacts in the form of spring fingers which are positioned to protrude into the unoccupied slots. These spring fingers serve as contact portions that contact selected terminal pins. In this construction, each connector has to be custom configured for each installation.

In the connector shown in U.S. Pat. No. 4,826,443, issued May 2, 1989, the individual termination ends of the signal contacts of the connector extend rearwardly past a body of the connector to define a termination area. No grounding shield is shown or described as being used to cover the termination area in order to provide shielding throughout the termination portion of the connector. At higher frequencies that are used for data transmission, the potential for signal-disrupting crosstalk increases greatly and unless the entire signal contacts are shielded, the possibility of occurrence of crosstalk increases.

The present invention is therefore directed to a novel and unique grounding shield for use with cable connector wafers, or modules, which overcomes the aforementioned disadvantages and which provides improved shielding throughout the length of the connector and in the termination area of the signal contacts.

SUMMARY OF THE INVENTION

Accordingly, it is a general object of the present invention to provide an improved grounding shield for use with wafer connector modules which has a simple standard construction, and permits ease of assembly.

Another object of the present invention is to provide a grounding shield for use with wafer connectors which does not increase the connector size or result in a decrease of pin density in an opposing, mating connector.

Yet another object of the present invention is to provide a grounding shield of singular configuration that may be easily varied, as in its width, to accommodate as many grounding paths as desired.

A still further object of the present invention is to provide a grounding shield that extends over the signal termination area of the cable connector from between the rear edge of a grounding shield of the connector and the grounding shield of the cables terminmated tot he connector, and an insulator that is interposed between the shield and the signal contact termination areas, the insulator having a thickness and a dielectric constant that may be varied so as to adjust the impedance of the cable connector in the termination area and without modifying the configuration of the connector.

Yet one more object of the present invention is to provide a high-density cable connector with a grounding shield having a length sufficient to extend over a termination area of the signal contacts of the connector, the shield having a plurality of openings formed therein aligned with the signal contacts which define windows opening through the shield which facilitate the termination of the signal contacts of the connector, without altering the configuration of the connector.

The present invention accomplishes these and other objects by way of its unique structure. In accordance with one principal aspect of the present invention, a connector is provided with an insulative housing with a defined body portion, the body portion including a receptacle defined therein that accommodates a plurality of conductive terminals, each of which has a contact assembly for contacting a conductive pin of an opposing connector. A conductive grounding shield that fits on the connector housing body portion partially encloses the terminals in the receptacle portion of the connector housing. The grounding shield may have a center tab that extends rearwardly between the signal contact termination portions. An insulative insert is provided that extends over the termination portions of the signal contacts and it preferably has a thickness that matches that of the housing grounding shield. A second grounding shield is applied over the insert and has a center tab that extends through an opening of the insert to make contact with the center tab of the connector housing center tab. The insert separates the signal contact terminations portions from the grounding shields.

In another principal aspect of the present invention, the insert is preferably formed from a dielectric material and the material is chosen to have a dielectric constant that will form a desired impedance among the terminals and the grounding shield of the cable connector so that the impedance of the connector may be tuned through the termination area thereof.

In yet another principal aspect, the present invention includes an electrical connector module having an insulative body portion with a series of conductive terminals disposed within the body portion. The connector has a grounding shield which lies upon the outer surface of the body portion and which includes a cover portion that extends in a first plane. The grounding shield has at least one depression formed therein that extends away from the cover portion thereof and into opposition with a selected one of the connector terminals. This depression includes a contact portion spaced away from the grounding shield cover portion that is supported in its extent by a portion of the grounding shield that is also drawn during the forming process.

In the preferred embodiment, the depression contact portion or a tip thereof, extends within a second plane, different from and generally parallel to the first plane so that the grounding shield contact portion may easily abut one of the connector terminals. A dielectric insert is provided having one or more apertures formed therein that provide passages through which the depressions extent in their path of ground contact to selected terminals. The contact portions of the grounding shield are preferably joined to their corresponding opposing terminals, such as by resistance welding or the like.

These and other objects, features and advantages of the present invention will be clearly understood through consideration of the following detailed description.

BRIEF DESCRIPTION OF THE DRAWINGS

In the course of the following detailed description, reference will be made to the accompanying drawings in which.

DETAILED DESCRIPTION OF THE PREFERRED EMBODIMENTS

Figure 1:
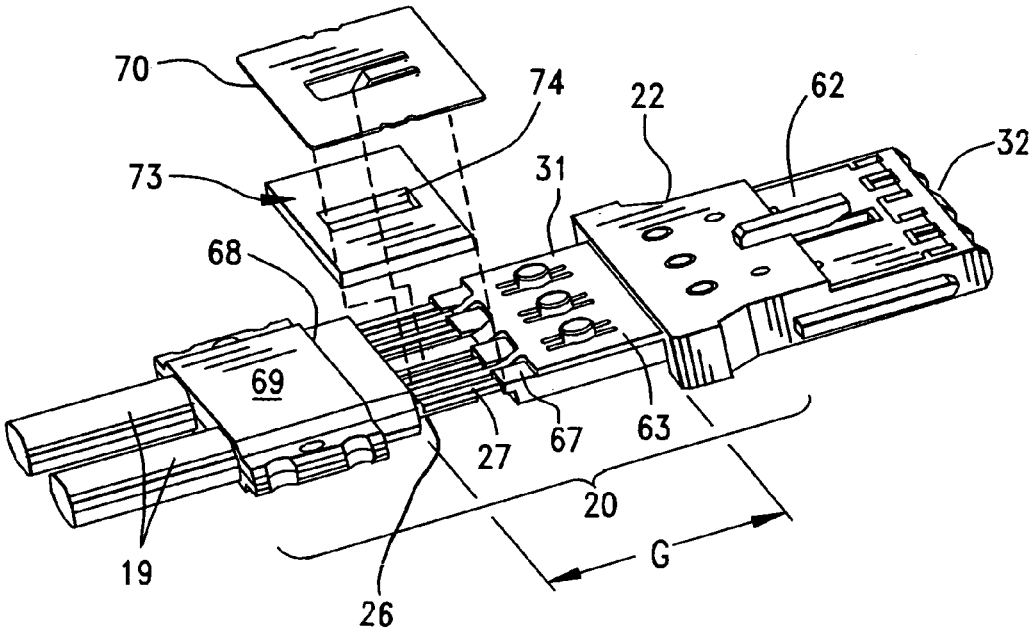
FIG. 1 is an exploded perspective view of one embodiment of a wafer connector with an extended grounding shield constructed in accordance with the principles of the present invention.
Figure 1A:
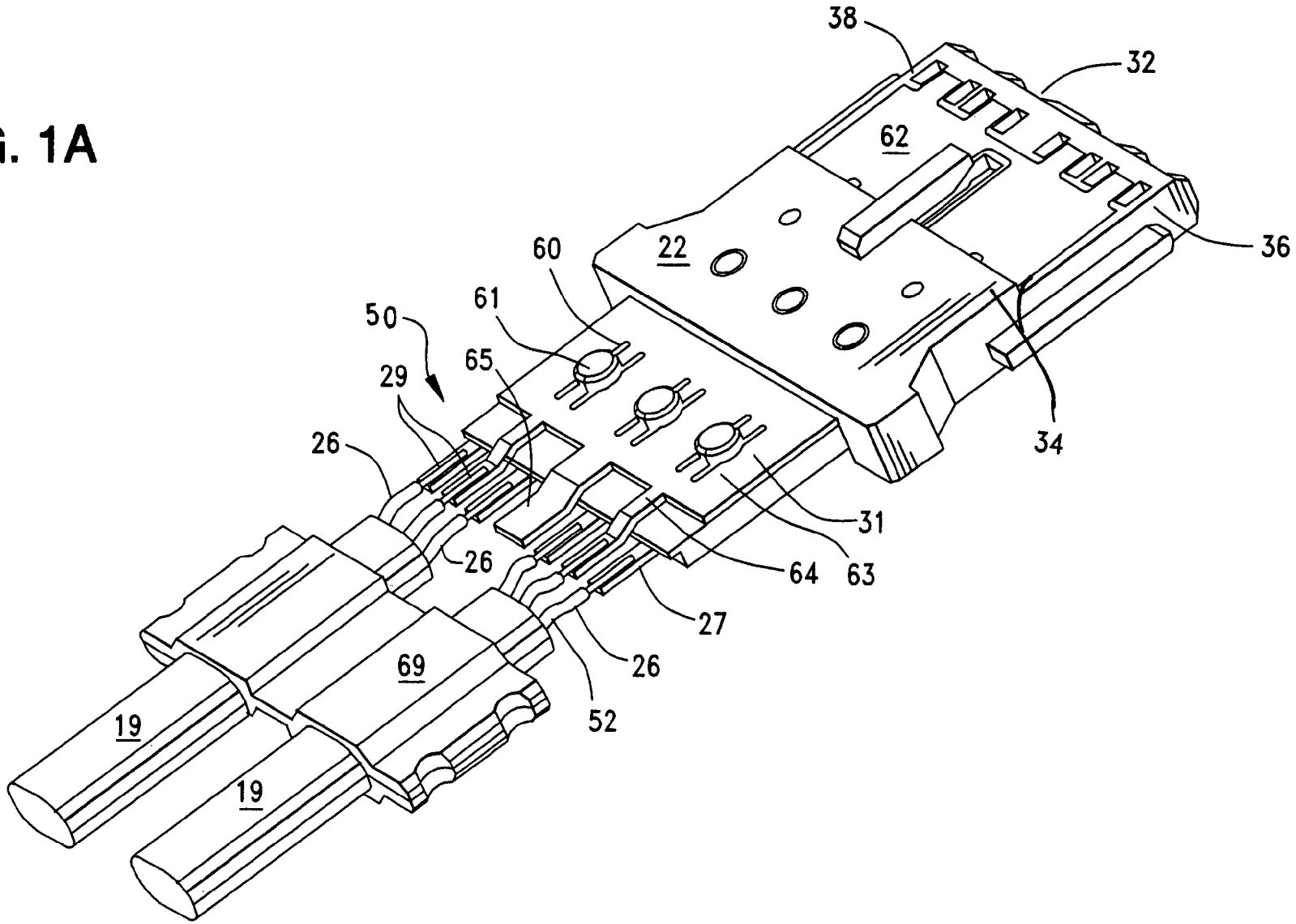
FIG. 1A is a perspective view of the connector housing and cables, taken from a different orientation to show the termination area of the connector.

FIGS. 1 and 1A illustrate an electrical connector element, or module 20, which has a relatively thin profile and such a connector is commonly termed a "wafer" connector in the art. The connector module 20, as is known in the art, has a primary housing 22 formed from an electrically insulative material which houses a plurality of conductive terminals 24. These terminals 24 extend through the connector primary housing 22 in order to provide conductive paths between individual wires 26, that are arranged near along a rear end of the primary housing 22. The wires 26 are held within a 19 that may have (not shown) an inner braided wire shield that encompasses the two signal wires 26. Typically, one such cable 19 will contain two individual signal wires 26. The front end 32 of the primary housing 22 (and the module 20) that is adapted for insertion into an opposing backplane-style connector, such as a pin header (not shown) that includes a plurality of conductive pins arranged in rows between two sidewalls.

Figure 2:
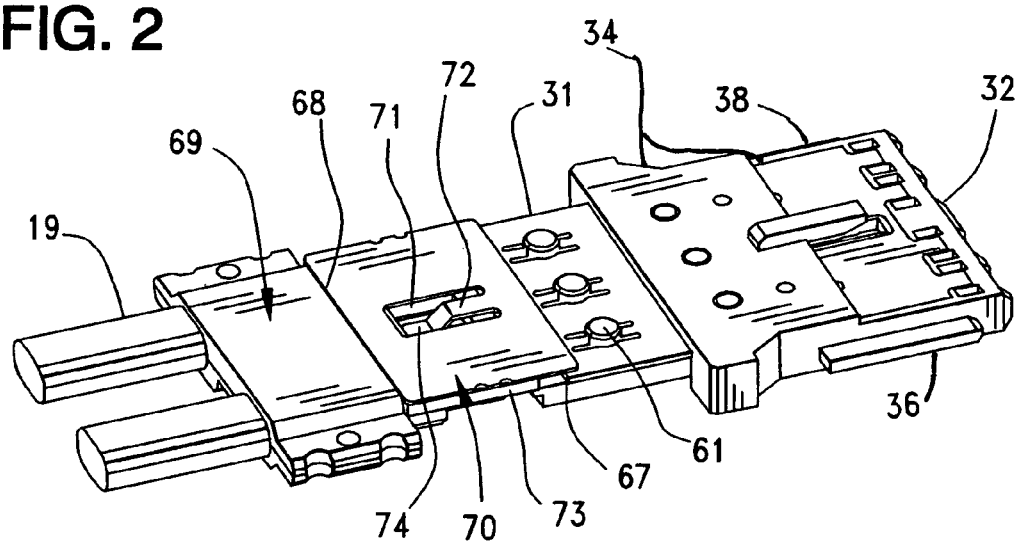
FIG. 2 is the same view as FIG. 1, but illustrating the insert and grounding shield extension assembled to the connector housing.
Figure 3:
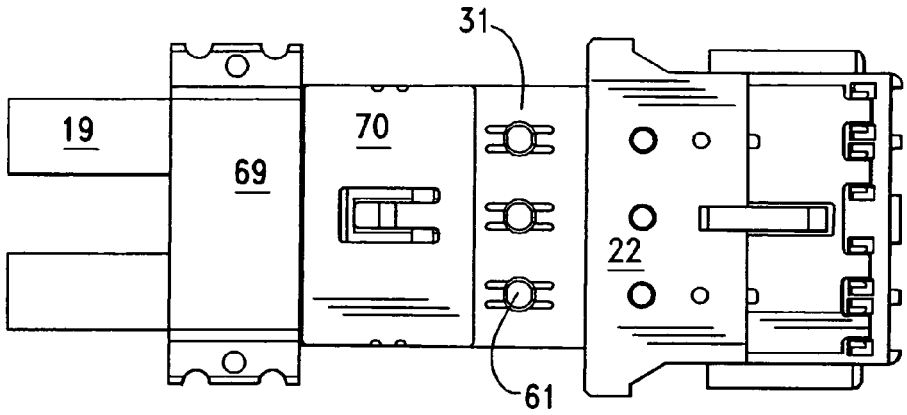
FIG. 3 is a top plan view of the connector of FIG. 2.
Figure 4:
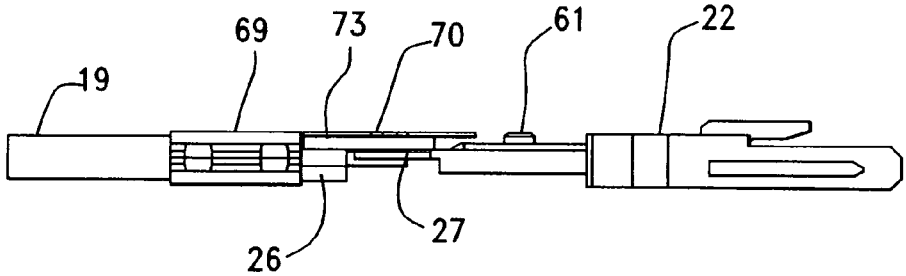
FIG. 4 is a right side elevational view of the connector of FIG. 2.
Figure 6A:
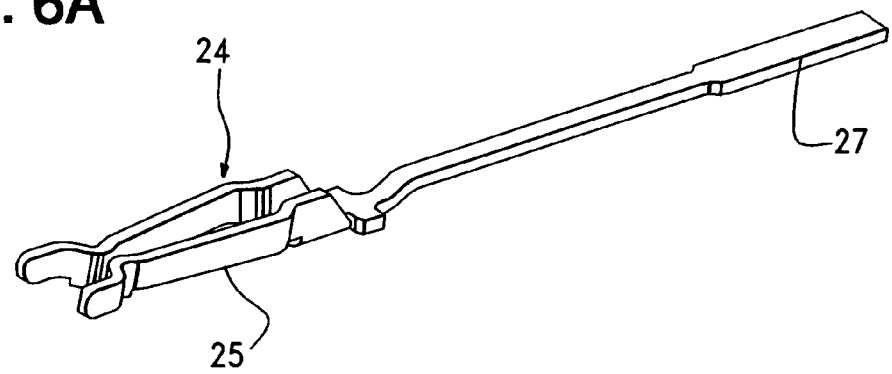
FIG. 6A is a perspective view of a terminal used in the connector of FIG. 6.
Figure 5:
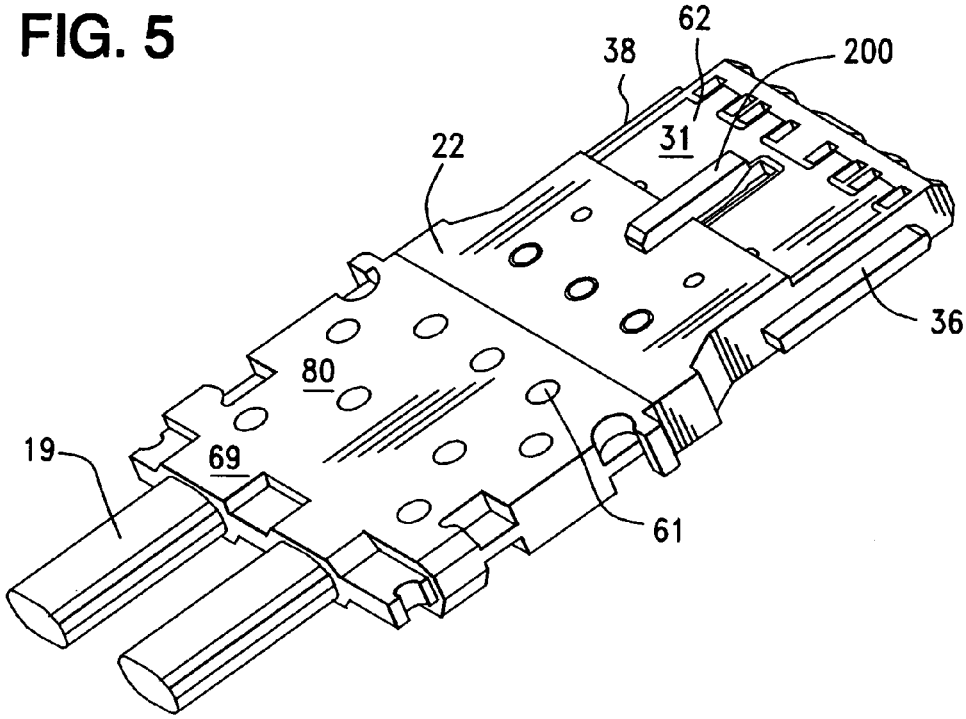
FIG. 5 is a perspective view of the connector of FIG. 2, with the outer insulative body molded thereto.
Figure 6:
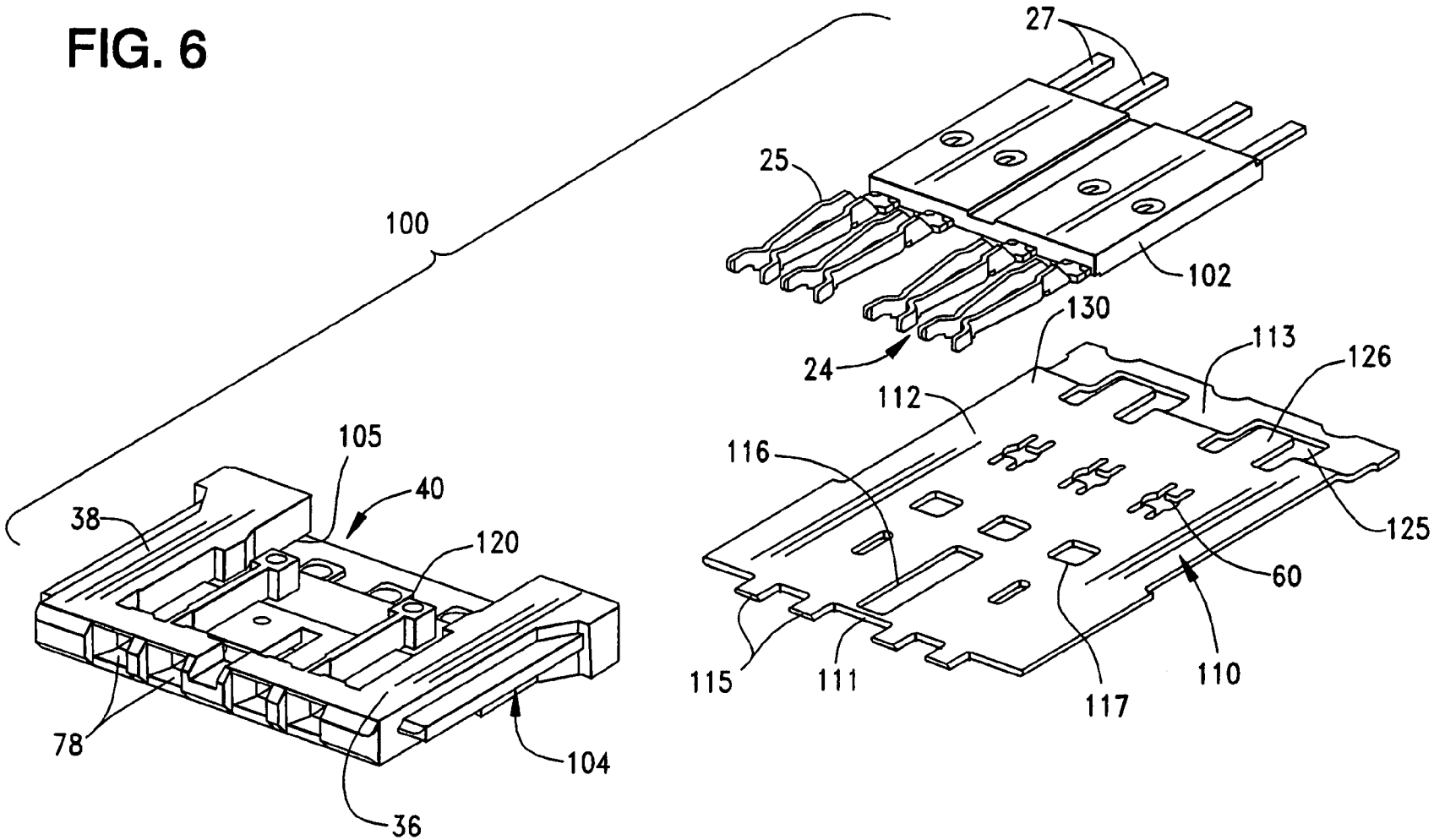
FIG. 6 is a partially exploded view of an alternative embodiment of a connector housing constructed in accordance with the principles of the present invention and utilizing an integrated grounding shield.

The front end 32 of the connector 20 includes a plurality of pin-receiving passages 78, which are best illustrated in FIG. 6 that are aligned with each internal terminal 24 of the connector and which permit the entrance of the pins of the opposing backplane connector to enter during engagement of the connector 20 and the backplane connector. The wires 26 that are terminated to connectors of the present invention typically include coaxial wires or pairs of wires that have a center conductor 29 (FIG. 1A) which are held in an outer jacket 52 and they may be surrounded by a grounding shield in the form of a braided wire shield, metallic film wrapper or the like and which may further include a drain wire 51 of the cable 19. In either situation, both signal conductors and ground conductors enter the secondary connector housing 80 for termination (FIG. 5). In order to maintain the ground paths associated with these wires, the connectors 20, and particularly their primary housings 22, are provided with a grounding shield 31 that extends from near the front end 32 of the connector and which covers a portion of the connector housing 22 as shown in FIGS. 1–3.

The grounding shield 31, in order to maintain appropriate grounding paths should preferably make contact with selected terminals 24. This grounding shield is illustrated best in FIG. 1A and it can be seen in include a planar body that extends between a shield front portion 62 that extends over the contacts of the terminals 24 and a rear portion 63 that is attached to the connector body portion 34 and which extends into the termination area 50. In the prior art, this grounding shield did not extend over or into the termination area 50 which is the area where the conductors 29 and the drain wires 51 of the cables 19 are terminated to the termination portions, or tails 27 of the conductive terminals 24. (FIG. 6A.) FIG. 1 illustrates the termination gap "G" that includes the termination area 50 and the area of attachment of the grounding shield 31 to the primary connector housing 22.

Figure 7:
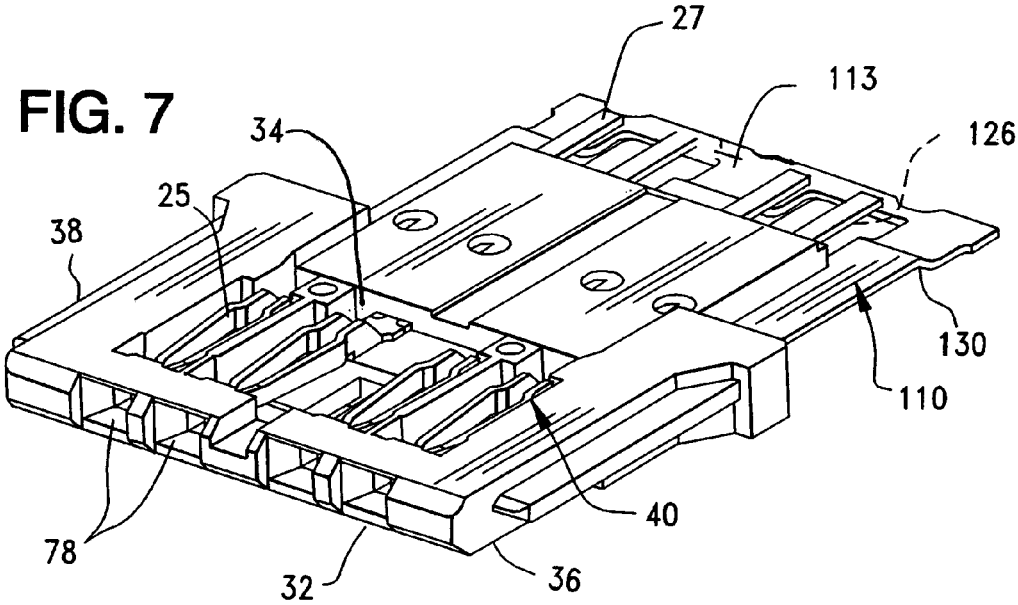
FIG. 7 is a perspective view of the connector of FIG. 6, shown in an assembled condition.
Figure 10:
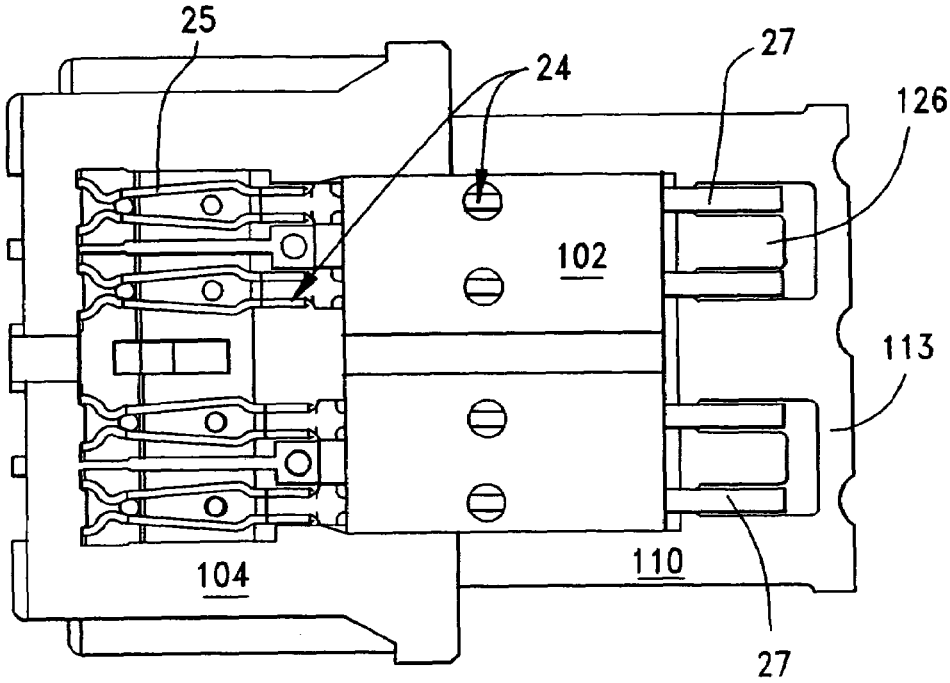
FIG. 10 is a bottom plan view of the connector of FIG. 9.

As illustrated best in FIG. 6, the primary connector housing 22 includes a body portion 34 and two sidewall portions 36, 38 that extend away from the housing body portion 34 toward the forward end 32 of the connector 20 for a preselected extent. These sidewalls 36, 38 and the body portion 34, cooperatively define a hollow, or recessed, receptacle area 40 (FIG. 6) in the connector housing 22. This receptacle area 40 houses a plurality of conductive terminals 24, and particularly the contact portions 25 thereof as best illustrated in FIGS. 7 & 10.

Returning to FIG. 1, it can be seen that the grounding shield 31 extends over a portion of the primary housing 22 and may include a series of slotted openings 60 that receive raised bosses 61 of the primary housing 22. The bosses 61 and openings 60 are sized so as to provide an interference fit. The remaining body of the grounding shield 31 that interconnects the shield front portion 62 to the shield rear portion 63 is not shown in FIG. 1 because it is embedded in the rear portion of the primary housing 22. This embedding may be accomplished in ways well known in the art, such as by insert molding, overmolding or the like. The grounding shield 31 in the final connector as shown in FIG. 5 is substantially embedded, or encased in an insulative material that makes up the secondary housing 80. The secondary housing 80 is molded over the termination gap G (FIG. 1) to fill that space and to also connect the primary housing 22 to the wire clamp 69 and thereby form an integrated connector module 20.

As illustrated best in FIG. 1A, the grounding shield 31 has two sets of grounding tabs 64, 65. The smaller of the two grounding tabs 64 are used to provide a termination surface to the drain wires 51 of the cables, while the larger of the two grounding tabs 65 is preferably located in the center of the array of wires (FIG. 1A) and it extends rearwardly. The open termination area shown in the drawings typically ranges from between about 0.1 to about 0.25 inches. At this small dimension, and with the close spacing of the free wire ends, the center grounding tab 65 is usually provided to prevent unintended crosstalk between the signal wires within each of the connectors, or "wafers" as well as between adjoining connectors/wafers. However, it has been found by us that providing more shielding over the termination area reduces the likelihood of crosstalk. The additional ground increases the electrical affinity between the signal wires and the ground.

In order to provide the desired additional ground for affinity with the signal wires, a second ground plate 70 is provided that covers the termination area 50 of the termination gap G and the second ground plate preferably extends, as best illustrated in FIG. 2, from the rear edge 67 of the grounding shield 31 to the forward edge 68 of the wire carrier, or clamp 69. Although the drain wires 51 of the cables 19 are attached to the grounding tabs 64 of the first grounding shield 31, which in turn is connected to the second grounding shield 70 to provide complete ground continuity, such continuity may be established by other means. For example, the rear edge of the second grounding shield 70 may be attached to the inner braided shields or whatever shielding is used with the cables 19, such as by soldering or clamping, while the front end of the second grounding plate makes contact with the rear portion 63 of the connector housing grounding shield 31.

A separate bridging member 73, formed from an insulative material, is also preferably provided in order to prevent unintended shorting contact from occurring with the termination portions of the signal terminals. In this regard, the insulative bridging member 73 has a length that is less than that of the second grounding plate 70 so that the front edge of the second ground plate 70 may make contact with the rear portion 63 of the connector grounding shield 31.

The bridging member preferably has an opening, or window 74 as shown that permits the passage of a contact tab 72 formed within a slot 71 of the second grounding shield. This contact tab 72 extends down through the opening and into contact with the grounding shield 31, and preferably the center grounding tab 65 thereof, and most preferably along the flat portion of the grounding tab 65 that extends between the two sets of cables. This contact is made within the plane of the termination of the signal and drain wires and is desirable to provide a complete ground circuit extending from the over the terminal contact portions 25 to over the termination area 50 and even a bit further rearward of that, to over the encased portion of the cables that project just forwardly of the wire clamp 69. In other words, the second grounding shield 70 bridges the termination area 50 between the connector grounding shield 31 and the shielding of the cable 19 within the confines of the termination gap G.

FIG. 5 illustrates the connector after it has been subjected to overmolding and illustrates a secondary housing 80 molded over the wire clamp 69, the free ends of the cables 19 and the rear part of the primary housing 22. This secondary housing 80 is insert molded or overmolded the connector 20 shown in FIG. 2. Portions of it will engage the raised bosses 61 to which the grounding shield 31 is attached. The secondary housing also serves to encase the grounding shield 31 and the second grounding shield 70. The bridging member 73 may be formed of an engineered dielectric, that is, one that has a specific dielectric constant in order to increase the electrical affinity between the second grounding shield 70 and the signal wires. Suitable dielectrics for use as the bridging member 73 may include LCP (liquid crystal polymer) and PTFE (teflon). Although the bridging member is shown in the drawings as having a significant thickness as if it were a molded member, it will be understood that the bridging member 73 may be formed from a thin film so long as it provides the necessary insulating function. In this manner, the impedance of the connector 22 may even be tuned throughout the termination area 50 by way of the thickness and dielectric material from which the bridging member is formed.

Figure 9:
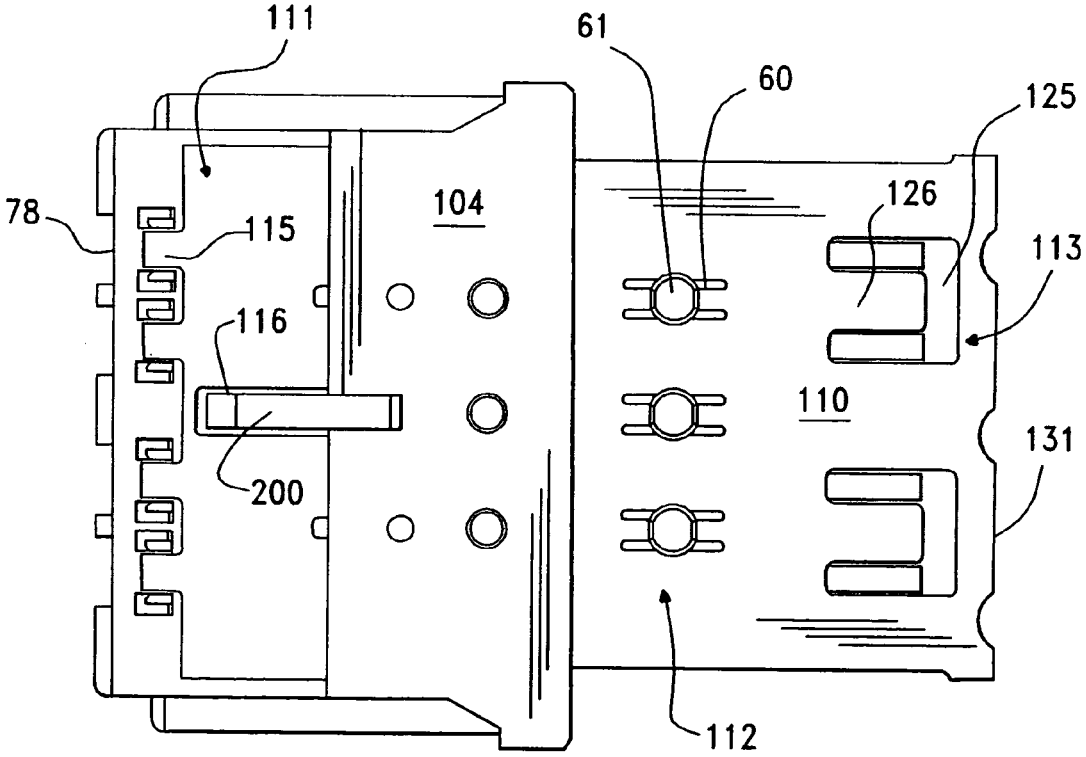
FIG. 9 is a top plan view of the connector of FIG. 8.

FIG. 6 illustrates another embodiment of an improved connector 100 with an integrated grounding shield that is constructed in accordance with the principles of the present invention. In this embodiment, the terminals 24 may be initially formed with a positioning block 102 so that the contact portions 24 of the terminal project from one side of the positioning block 102, and their termination tails 27 project from another, opposite side of the positioning block 102. The terminal contact portions 25 are received within the receptacle area 40 of a nose portion 104 of the connector. (FIG. 7.) A single, extended length grounding shield 110 is provided which has front, middle and rear portions 111, 112, 113. The front portion 111 of the shield 110 extends over a portion of the receptacle area 40 and is partially received within a slot 105 of the housing nose portion 104 so that its front edge, particularly tabs 115 thereof extend forwardly to cover the full extent of the terminal contact portions 25. (FIG. 9.)

Figure 8:
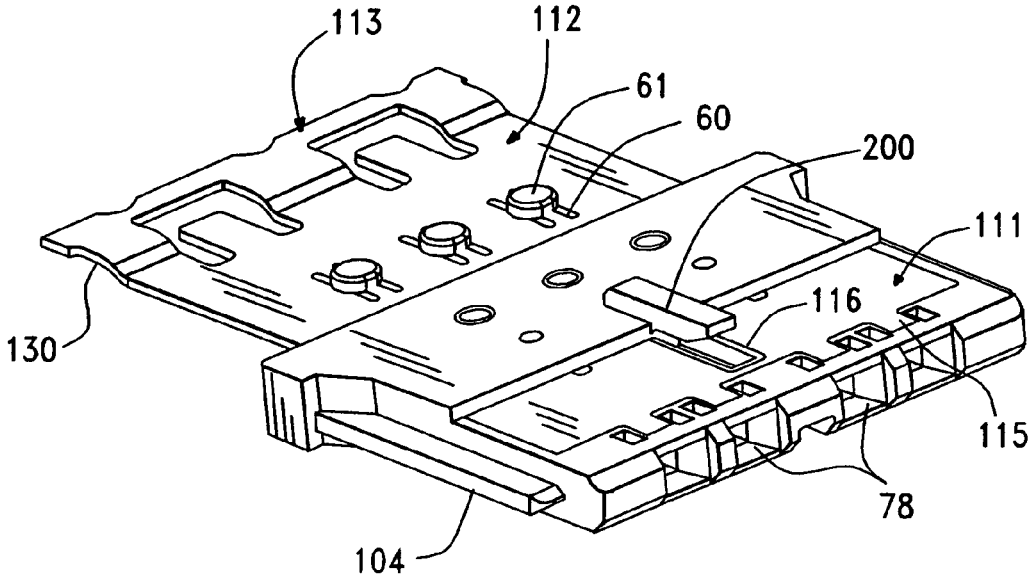
FIG. 8 is the same view as FIG. 7, but taken from the underside thereof.

The extended shield 110 also preferably includes slotted openings 60 that engage bosses 61 formed on one surface of the positioning block 102. The shield 110 also preferably includes other engagement openings 117 that engage, typically in an interference fit, raised bosses 120 that are formed as part of the nose portion 104. Another opening 116 is also preferably provided to fit over the polarizing key 200 formed on the connector body. (FIG. 8.)

Figure 7A:
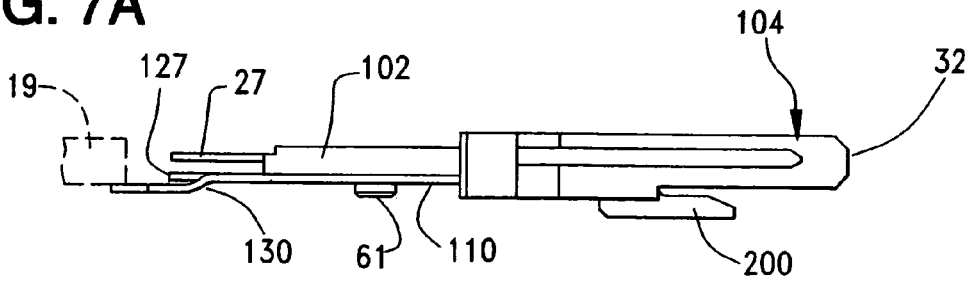
FIG. 7A is a side elevational view of the connector of FIG. 7 taken along lines 7A—7A thereof.
Figure 11:
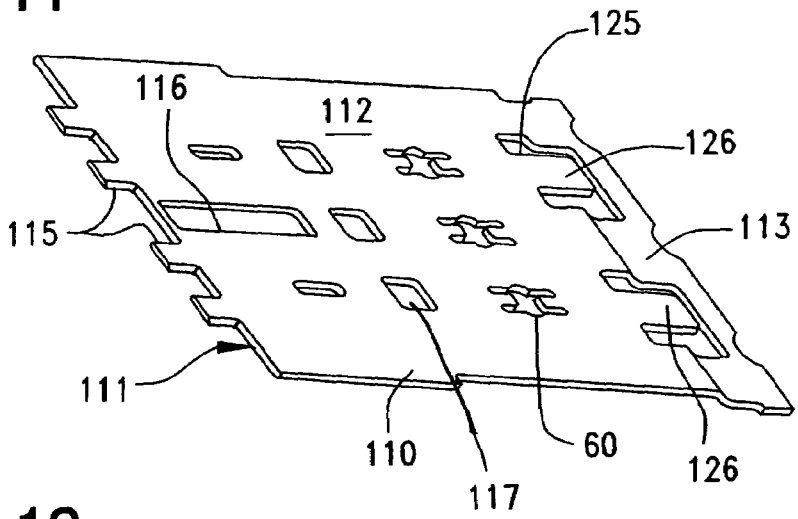
FIG. 11 is a perspective view of the grounding shield of FIG. 6.
Figure 12:
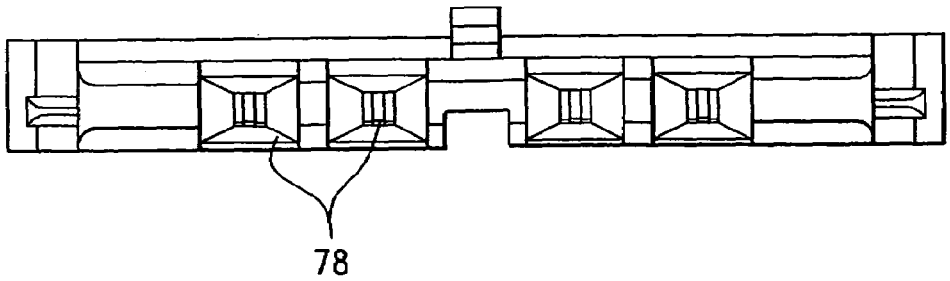
FIG. 12 is a front end view of the connector of FIG. 7.

The rear portion 113 of the grounding shield 110 has a pair of U-shaped slots 125 that define grounding tabs 126. The drain wires of the cables are attached to these grounding tabs 126, and the tabs 126 preferably extend within the plane of the grounding shield 110 and a clearance is provided for access to them for terminating the drain wires to them. The drain wire grounding tabs 126 are spaced apart from and preferably lie in a different plane that the terminal termination tails 27 as shown best in FIG. 7A. In this regard, the rear portion 113 of the grounding shield 110 may be formed in a step-like configuration, which is best illustrated in FIGS. 6, 7A and 11. Not only does the step 130 facilitate access and termination, but it also permits the rear edge 131 of the shield 110 to engage a rear portion of the connector assembly, such as a wire clamp, or carrier (not shown) of the style shown at 69 in FIGS. 1–5, or to engage the inner braided shield of the cables 19 as shown in phantom in FIG. 7A. In this regard, this embodiment of the invention differs from the earlier embodiment discussed above in that the tab member at the rear edge of the shield 110 extends completely widthwise between opposite sides of the shield 110 in contrast to the earlier embodiment where the tab member 72 has a lesser width and extends only between two sets of the cables.

While the particular preferred embodiments of the present invention have been shown and described, it will be obvious to those skilled in the art that changes and modifications may be made without departing from the teachings of the invention.

We claim:

1. A wafer connector for connection to a backplane, comprising:

an insulative connector housing having a mating end and a termination end, a plurality of conductive contacts disposed within the housing for connecting to a like plurality of conductors of a plurality of cables, each of the cables including at least one signal wire and a shielding member associated with the signal wire, the connector contacts including a plurality of signal contacts and at least one ground contact, a first conductive grounding shield supported by the connecting housing extending over the contacts and having an elongated ground member extending rearwardly from the first grounding shield into a termination area between at least two of the cables, and, a shielding assembly extending over the termination area, the shielding assembly including an insulative bridging member that extends between a rear edge of the first grounding shield and the cable shielding member, and a second conductive grounding shield overlying the bridging member, the second grounding shield also extending between and making contact with the first grounding shield rear edge and of the cable shielding member to provide grounding to said connector between said first grounding shield and said cable shielding member.

2. The wafer connector of claim 1, wherein said first grounding shield includes a pair of termination members that extend rearwardly from a body portion of said first grounding shield into said termination area, and said first grounding shield further includes a tab member that extends rearwardly from said first grounding shield body portion into said termination area, said first grounding shield body portion extending lengthwise in a first plane and said termination members and tab member being offset from said first grounding shield body portion such that they extend in a second plane which is different than and is spaced apart from the first plane.

3. The wafer connector of claim 1, wherein said first grounding shield includes a U-shaped opening slot formed therein that defines said first grounding shield tab member.

4. The wafer connector of claim 1, wherein said insulative bridging member has a length which is less than a corresponding length of second grounding shield so that an end of said second grounding shield makes electrical contact with said first grounding shield body portion.

5. The wafer connector of claim 1, further including, wherein said insulative bridging member is formed from a sheet of film.

6. The wafer connector of claim 1, further including, wherein said insulative bridging member is formed from either Teflon or liquid-crystal polymer.

7. The wafer connector of claim 1, wherein said second grounding shield further includes a contact member that extends through said bridging member for contacting said first grounding shield and electrically connecting said first and second grounding shields together.

8. The wafer connector of claim 7, wherein said insulative bridging member includes an opening and said second grounding shield includes a contact member extending therefrom through the bridging member opening into contact with said first grounding shield tab member.

9. The wafer connector of claim 7, further including, wherein said first grounding shield tab member includes a flat portion that extends between two of said cables in said termination area and the flat portion is spaced apart from said second grounding shield.

10. The wafer connector of claim 9, further including, wherein said second grounding shield contact member also extends between two of said cables in said termination area and contacts said first grounding shield tab member flat portion.

11. A cable connector, comprising:

an insulative connector housing having a mating end and a termination end the connector housing including a plurality of conductive terminals disposed therein, the terminals including contact portions for mating to terminals of an mating connector and tail portions for terminating to a plurality of cables, each of the cables including multiple wires and an associated ground, the connector terminal tail portions extending rearwardly in a first plane;

a first grounding shield supported by the connecting housing and extending over said terminal contact portion, the first grounding shield including a plurality of tail portions that extend therefrom into a termination area of the connector, said first grounding shield having a body portion extending in a second plane and the first grounding shield tail portions extending from the first grounding shield body portion and into the first plane, the first grounding shield tail portions being interposed between selected terminal tail portions, one of said of first grounding shield tail portions extending lengthwise between two of said cables; and, a second grounding shield overlying the connector termination area and extending between said first grounding shield body portion and said cable associated grounds.

12. The cable connector of claim 11, further including an insulative bridging member that is interposed between said first and second grounding shields, the bridging member preventing contact between said second grounding shield and selected terminal tail portions of said first grounding shield.

13. The cable connector of claim 12, wherein said insulative bridging member includes an opening through which a portion of said second grounding shield extends through into contact with said first grounding shield.

14. The cable connector of claim 12, wherein said bridging member has a length that is less than a length of said second grounding shield so that an edge of said second grounding shield contacts said first grounding shield body portion.

15. The cable connector of claim 12, wherein one of said first grounding shield tail portions includes an elongated tab member that extends in an offset manner from said first grounding shield body portion into said second plane and between two of said cables.

16. The cable connector of claim 15, wherein said second grounding shield includes a tab member that extends through said bridging member opening into contact with said first grounding shield tab member in said second plane.

* * * * *